US009540804B1

(12) United States Patent
Farahmandpour

(10) Patent No.: US 9,540,804 B1
(45) Date of Patent: Jan. 10, 2017

(54) CLADDING ATTACHMENT SYSTEM

(71) Applicant: Kamran Farahmandpour, Long Grove, IL (US)

(72) Inventor: Kamran Farahmandpour, Long Grove, IL (US)

( * ) Notice: Subject to any disclaimer, the term of this patent is extended or adjusted under 35 U.S.C. 154(b) by 0 days.

(21) Appl. No.: 14/743,324

(22) Filed: Jun. 18, 2015

(51) Int. Cl.

| | |
|---|---|
| ***E04F 13/08*** | (2006.01) |
| ***E04B 1/76*** | (2006.01) |
| ***E04B 1/41*** | (2006.01) |
| ***E04B 1/80*** | (2006.01) |

(52) U.S. Cl.
CPC ..... *E04B 1/7637* (2013.01); *E04B 1/40* (2013.01); *E04B 1/7629* (2013.01); *E04B 1/80* (2013.01); *E04F 13/0801* (2013.01)

(58) Field of Classification Search
CPC ..... E04F 13/24; E04F 13/25; E04F 13/26; E04F 13/28; E04F 13/0807; E04F 13/0801; E04B 1/7637; E04B 1/7329; E04B 1/40; E04B 1/30
USPC ..... 52/775
See application file for complete search history.

(56) References Cited

U.S. PATENT DOCUMENTS

| | | | | |
|---|---|---|---|---|
| 3,681,885 | A * | 8/1972 | Goggins | E04F 13/0801 52/288.1 |
| 3,760,544 | A | 9/1973 | Hawes et al. | |
| 4,462,194 | A | 7/1984 | Wahner | |
| 4,597,702 | A | 7/1986 | Brown | |
| 5,183,232 | A * | 2/1993 | Gale | A47B 96/06 248/220.22 |
| 5,426,905 | A | 6/1995 | Rollhauser et al. | |
| 5,611,184 | A | 3/1997 | Felix | |
| 5,660,015 | A | 8/1997 | Kluser | |
| 5,671,576 | A | 9/1997 | Kluser | |
| 6,314,694 | B1 | 11/2001 | Cooper | |
| 7,059,577 | B1 | 6/2006 | Burgett | |
| 7,818,935 | B2 * | 10/2010 | Velickovic | E04B 2/8652 24/573.11 |
| 8,161,705 | B2 * | 4/2012 | Pratt | E04F 13/0803 52/238.1 |
| 8,567,145 | B1 | 10/2013 | Chauncey | |
| 8,590,244 | B2 * | 11/2013 | O'Riordan | E06B 3/485 160/229.1 |

(Continued)

FOREIGN PATENT DOCUMENTS

| | | | | |
|---|---|---|---|---|
| BR | WO 2012055001 A1 * | 5/2012 | | E04F 13/0807 |
| DE | 3235979 A1 * | 3/1984 | | E04F 13/0807 |
| IT | EP 2915933 A1 * | 9/2015 | | E04F 13/0807 |

*Primary Examiner* — Christine T Cajilig
(74) *Attorney, Agent, or Firm* — Erickson Law Group, PC

(57) ABSTRACT

Cladding attachment system is disclosed having a base and an attachment member. The base has an engaging wall extending from a back plate. A base gusset plate extends between the engaging wall and the back plate. The engaging wall has a plurality of base teeth. The back plate is configured to attach to a support wall. The attachment member has a receiving wall extending from a mounting plate. The receiving wall has a receiving channel configured to receive the engaging wall. The receiving wall has two interior walls and a gusset channel. Each interior wall comprises one or more receiving teeth extending into the receiving opening to engage one or more of the base teeth to releasably join the attachment member to the base. The mounting plate comprises a surface for supporting cladding.

26 Claims, 10 Drawing Sheets

(56) References Cited

U.S. PATENT DOCUMENTS

| | | | | |
|---|---|---|---|---|
| 8,646,237 | B1 * | 2/2014 | Takagi | E04B 2/10 52/464 |
| 8,789,339 | B2 * | 7/2014 | Di Scola | E04F 13/14 52/405.3 |
| 2003/0070379 | A1 | 4/2003 | Worley | |
| 2007/0068101 | A1 * | 3/2007 | Weir | B32B 5/245 52/302.1 |
| 2007/0227086 | A1 | 10/2007 | Beavers et al. | |
| 2011/0094173 | A1 * | 4/2011 | Parker | E04B 2/702 52/261 |

* cited by examiner

CLADDING ATTACHMENT SYSTEM

FIELD OF THE INVENTION

This invention relates in general to system and devices for attaching cladding.

BACKGROUND OF THE INVENTION

The use of continuous insulation is mandated for some climates in the United States by newer energy codes. The purpose of continuous insulation is to eliminate thermal breaks that reduce thermal efficiency of insulation placed between framing members such as wall studs.

Cladding can be placed over rigid insulation boards or foam that are placed outside of an air barrier (AB)/weather-resistive barrier (WRB). The use of continuous insulation with cladding requires the cladding to be connected to the support or back-up wall behind the AB/WRB. In many applications, the cladding system will require a continuous attachment mechanism that bridges the thickness of the insulation and provides a flange for attachment of the cladding. Such attachment strips typically consist of a "Z" shaped metal device which poses a continuous line of thermal bridging through the insulation.

The present inventor recognized the need for a cladding attachment system that reduces thermal bridging where the continuous insulation is traversed. The present inventor recognized the need for a cladding attachment system that is less susceptible to deterioration by moisture and weather conditions.

When installing continuous insulation panels, the panels are often installed in complete contact with the AB/WRB on the back-up surface. This prevents proper drainage of water on the exterior face of the AB/WRB. Water can be trapped in the minute gap between the continuous insulation and AB/WRB due to capillary action. This trapped water can cause accelerated deterioration of ties and other components.

The present inventor recognized the need for a cladding attachment system that creates a gap between the continuous insulation panels and AB/WRB. This gap facilitates drainage.

Continuous insulation panels are often installed with adhesive backing to ensure they stay in place. This adhesive backing can impede drainage of water on the drainage plane and can degrade and fail over time under certain circumstances. This adhesive backing will also results in additional labor and material costs.

The present inventor recognized the need for a cladding attachment system that can retain the continuous insulation panels in place and eliminate the need to rely on adhesive backing.

The present inventor recognized the need to transfer some compressive force from the cladding attachment system onto the insulation to reduce or eliminate the possibility of buckling under compressive loads and to reduce the effective span within the cavity.

The present inventor recognized the need for a cladding attachment system that can support increased vertical load when oriented horizontally.

SUMMARY OF THE INVENTION

A cladding attachment system is disclosed. The system has a base and an attachment member. The base has an engaging wall, a back plate, and a base gusset plate. The engaging wall extends transversely from a back plate. The engaging wall comprising a plurality of base teeth. The back plate is configured to attach to a support wall. The base gusset plate is connected to the back plate and the engaging wall.

The attachment member has a mounting plate, a receiving wall, an attachment member gusset plate, and a gusset channel. The receiving wall extends transversely from the mounting plate. The receiving wall has a receiving channel configured to receive the engaging wall. The receiving channel is transverse to the mounting plate. The receiving wall comprises two interior walls adjacent the receiving channel. Each interior wall comprises a one or more receiving teeth that extend into the receiving channel to engage one or more of the base teeth to releasably join the attachment member to the base. The mounting plate comprises a surface for connecting cladding. The mounting plate is spaced apart from the back plate.

The attachment member gusset plate is connected to the receiving wall and the mounting plate. The gusset channel receives the base gusset plate when the engaging wall is received in the receiving channel.

A method of attaching cladding to a support wall is disclosed. A back plate of a base is attached to the support wall. The base has a horizontal engaging wall extending perpendicularly from the back plate. The engaging wall has a plurality of base teeth on opposite sides of the engaging wall.

A horizontally elongated receiving channel of a receiving wall of an attachment member is aligning vertically with the engaging wall. An attachment member gusset channel of the attachment member is aligned with a base gusset plate of the base. The base gusset plate is connected to the back plate and the engaging wall. The attachment member gusset channel intersects the receiving channel. The elongated receiving channel is moved over the receiving wall and the base gusset plate is moved into the attachment member gusset channel.

Receiving teeth are engaged on opposite sides of the elongated receiving channel with base teeth of the receiving wall to prevent the attachment member from moving in at least one first horizontal direction opposite the base. An insulation panel is held adjacent the support wall with a mounting plate of the attachment member. The mount plate is perpendicular to the receiving recess. Cladding is attached to the mount plate of the attachment member.

Numerous other advantages and features of the present invention will become readily apparent from the following detailed description of the invention and the embodiments thereof, from the claims, and from the accompanying drawings.

DETAILED DESCRIPTION

Figure 1:
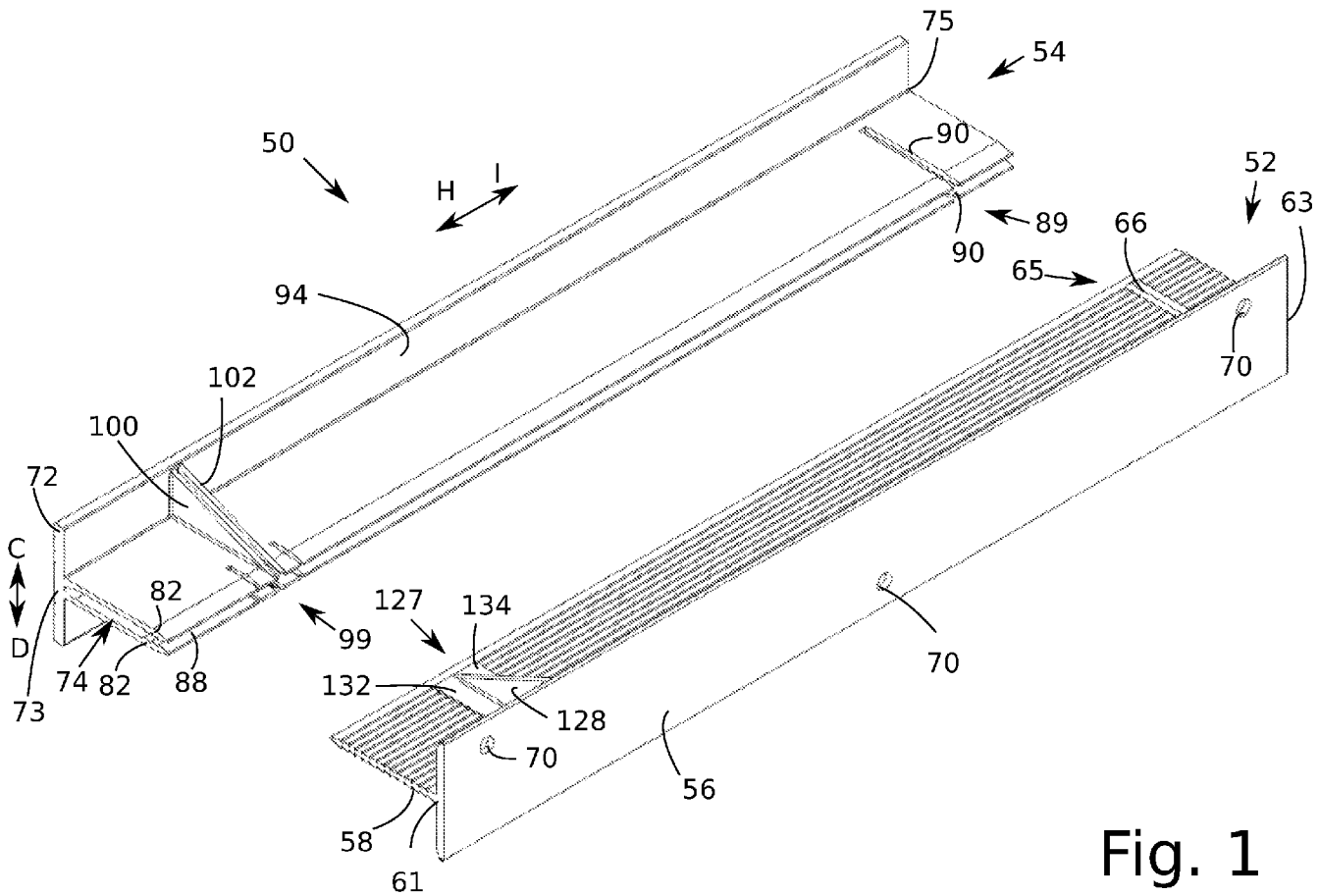
FIG. 1 is a perspective exploded view of a first embodiment of a cladding attachment system of the invention.

The following description is presented to enable any person skilled in the art to make and use the invention. For the purposes of explanation, specific nomenclature is set forth to provide a plural understanding of the present invention. While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 3:
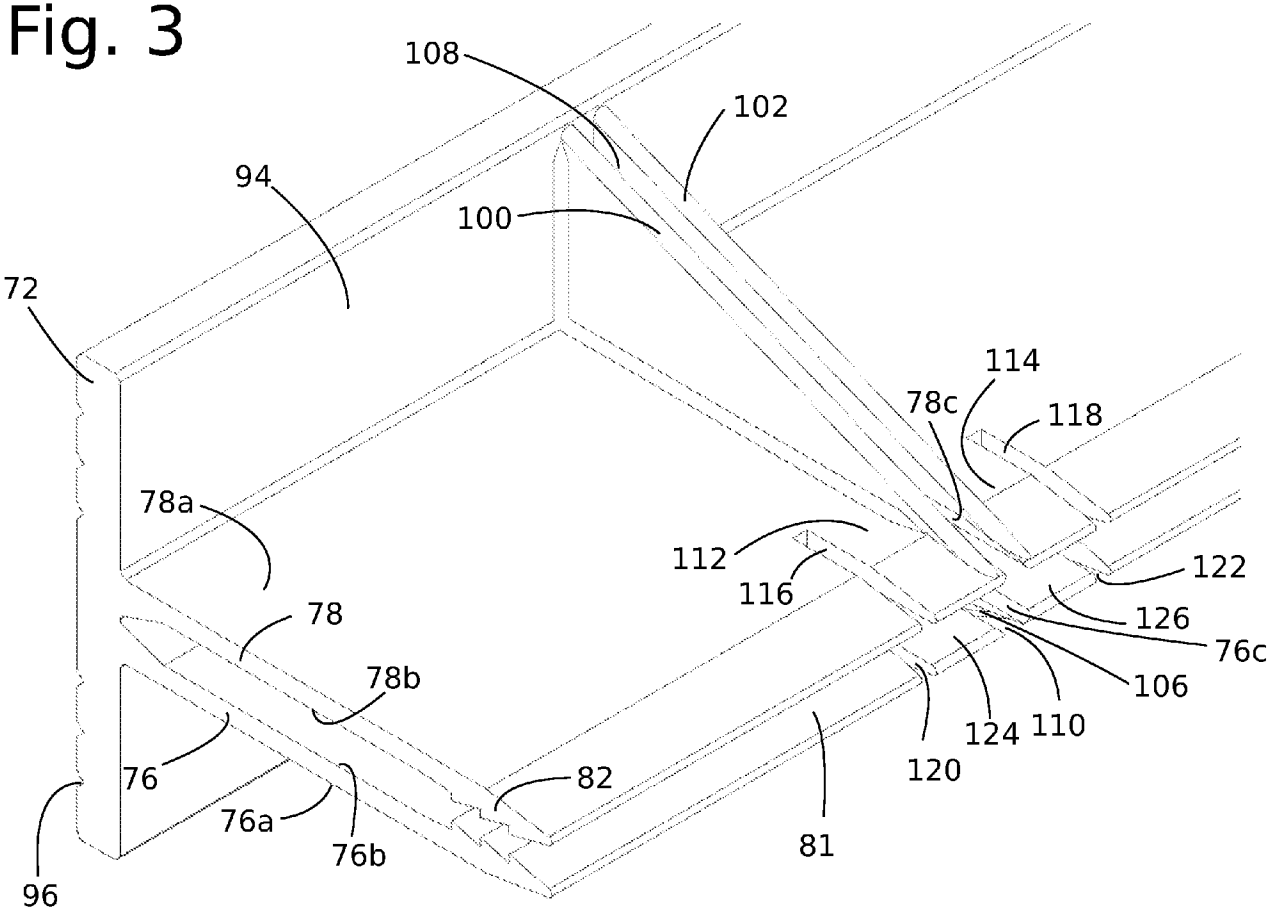
FIG. 3 is an enlarged perspective view of a portion of the attachment member taken from FIG. 1.
Figure 4:
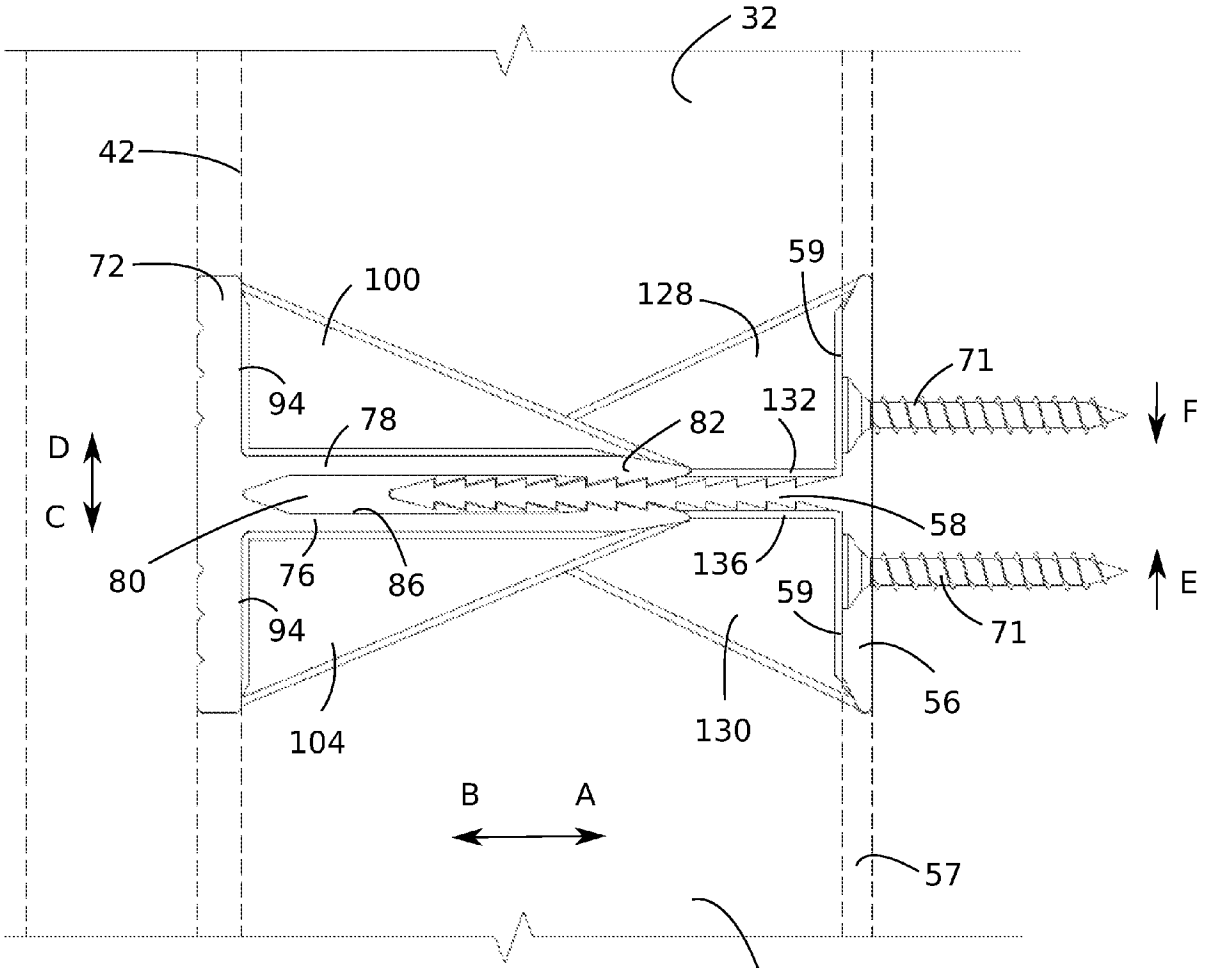
FIG. 4 is a first end view of the attachment system of FIG. 1.
Figure 5:
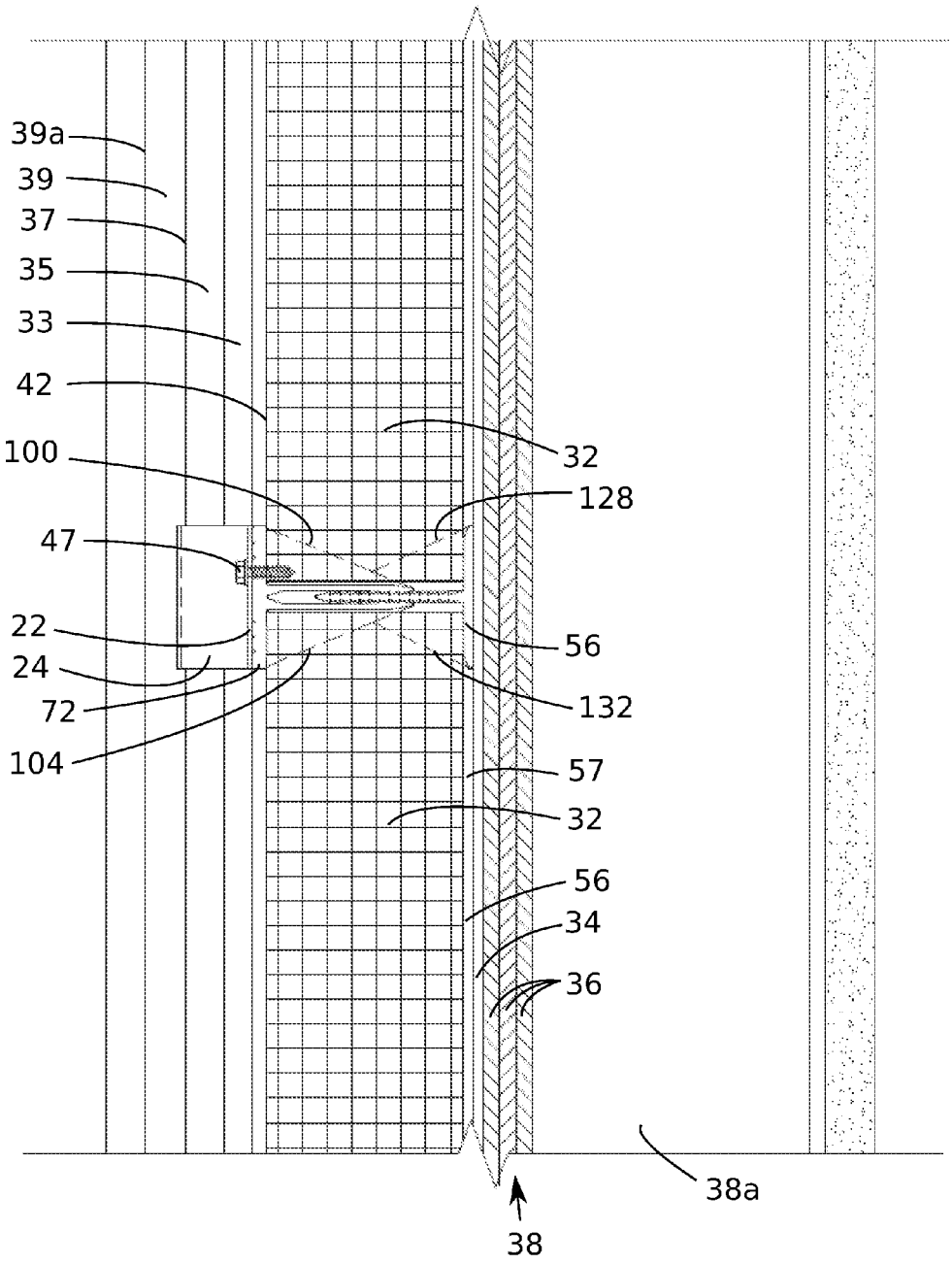
FIG. 5 is a first end view of the attachment system of FIG. 5 shown in one type of application.
Figure 6:
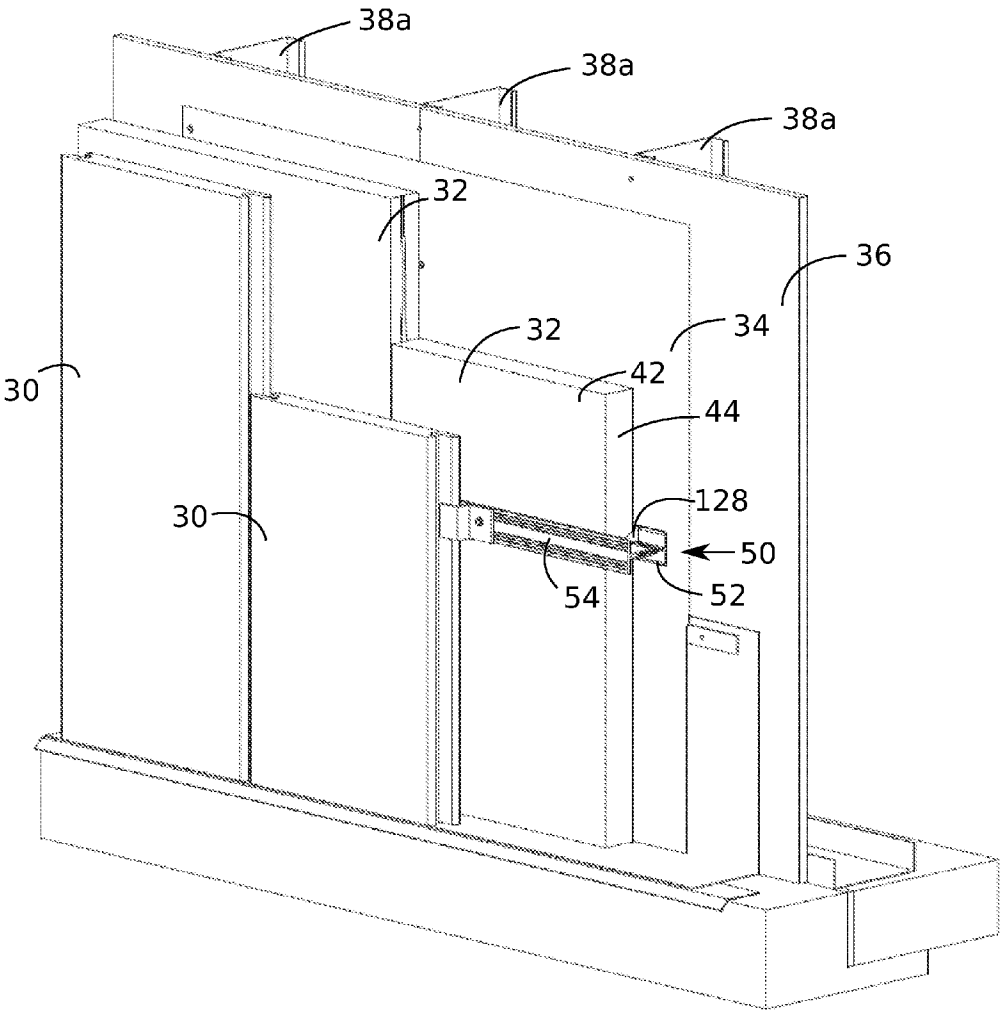
FIG. 6 is a perspective view of the attachment system of FIG. 1 shown in the application of FIG. 5.
Figure 7:
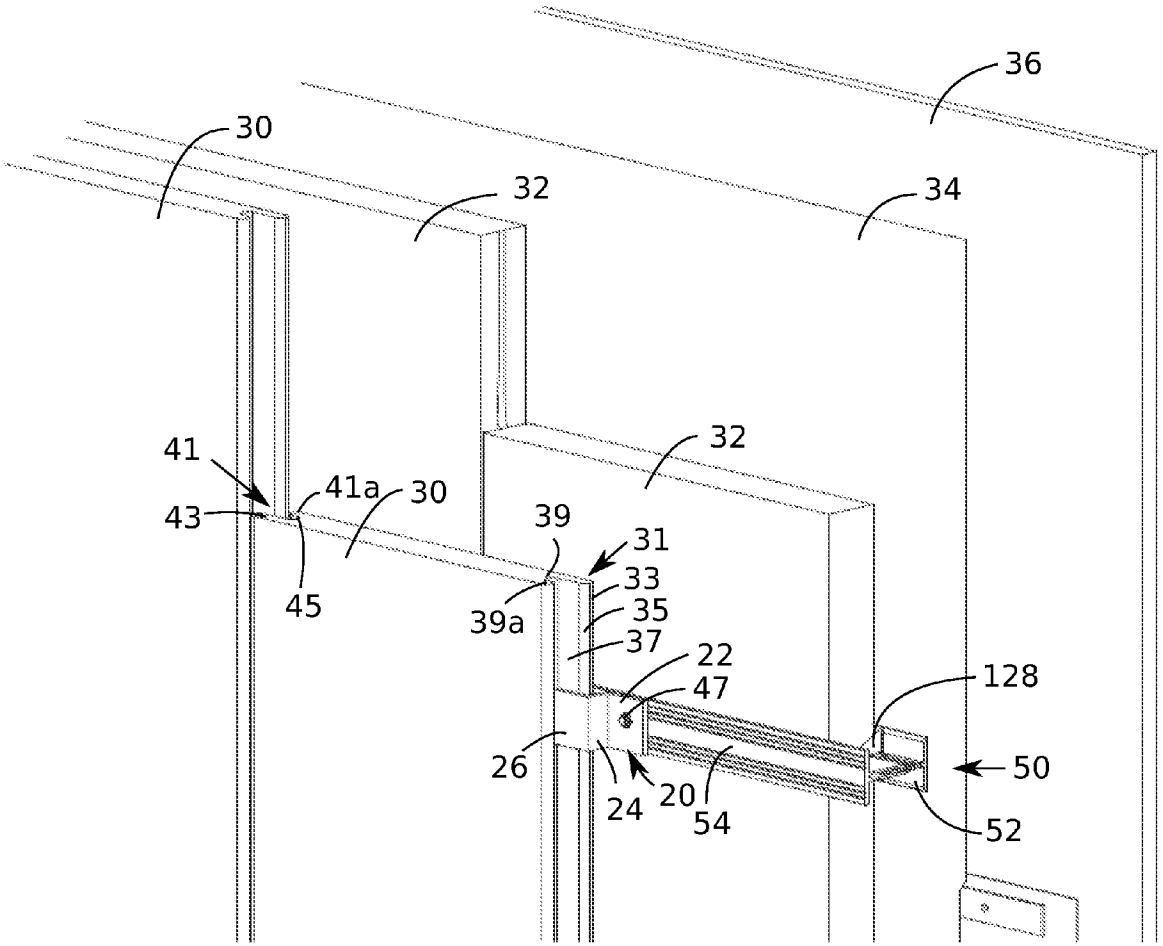
FIG. 7 is an enlarged perspective view of the attachment system from FIG. 6.

FIGS. 1-7 show a first embodiment of a cladding attachment system 50. The system 50 comprises a base 52 and an attachment member 54. In some embodiments, both components are manufactured, such as by injection molding, using a semi-rigid plastic material. FIGS. 5-7 show the system deployed in one type of application. The base is attached to a backup wall 38. In some embodiments, the backup wall 38 may have an air barrier (AB) and/or weather-resistant barrier (WRB) 34, placed over an exterior wall board or sheathing 36, placed over wall studs 38*a*. In some applications, the base 52 may be attached over the air barrier and/or weather-resistant barrier 34. The base 52 may be used on other walls or backup wall arrangements known in the art.

In some applications, the cladding is siding, stucco, metal panel systems, composite panels, or fiber cement panels, etc.

Figure 2:
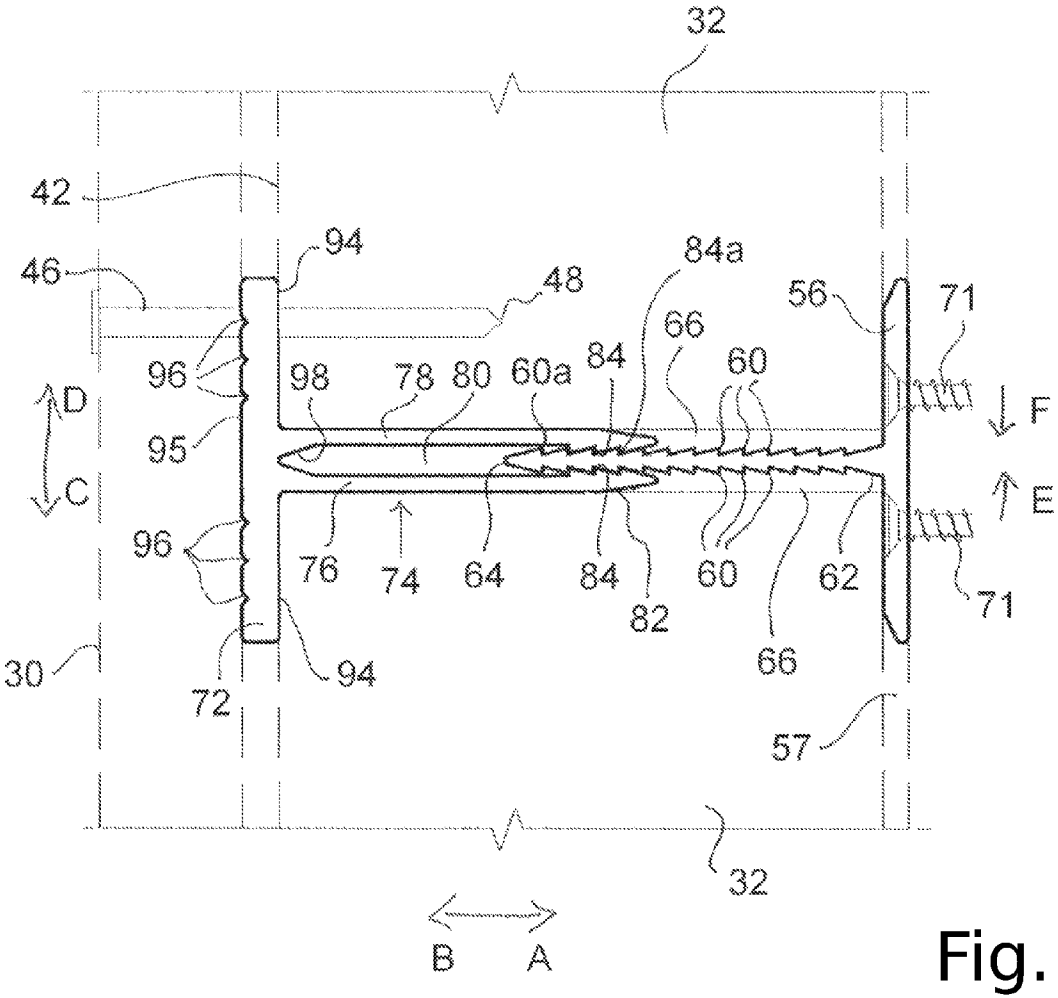
FIG. 2 is a second end view of the attachment system of FIG. 1 comprising an attachment member engaged with a base.

The base 52 has a back plate 56 and an engaging wall 58 extending from the back plate. In some embodiments, the wall 58 extends perpendicular from the back plate. The wall 58 has a plurality of base teeth 60 extending along opposite sides of the engaging wall 58, a back end 62 adjacent the back plate 56, a front end 64 opposite the back end 62. The base teeth on a first side of the engaging wall are mirror image identical to the corresponding base teeth on the opposite side of the engaging wall as shown in FIG. 2. The base has a horizontal length between a first end 61 and a second end 63.

While the engaging wall is shown having teeth along its entire length between the back end 62 and front end 64, in some embodiments, a portion thereof may be flat or blank without teeth. The engaging wall comprises a first guide bar area 65. The first guide bar area 65 comprises upper and lower guide protrusions, such as upper and lower guide bars 66 on opposite sides of the engaging wall that extend beyond the teeth. The guide bars have a flat surface. In some embodiments, the first guide bar area comprises one guide protrusion.

The back plate 56 comprises through going mounting fastener apertures/holes 70. While three apertures are shown any number of apertures can be provided and placed about the back plate. Fasteners, such as screws 71, are used to secure the base plate 56 to the backup wall 38.

The attachment member 54 has a mounting plate 72 and a receiving wall 74. The receiving wall 74 has lower and upper wall portions 76, 78, and a receiving channel or gap 80 between the wall portions 76, 78. The lower wall portion 76 has an outer surface 76*a* and an inner surface 76*b*. The upper wall portion 68 has an outer surface 78*a* and an inner surface 78*b*. The attachment member has a horizontal length between a first end 73 and a second end 75.

An end opening 88 provides access to the receiving channel 80 opposite the mounting plate 72. At an outer end of each wall portions 76, 78 opposite the base is a toothed section 82. The tooth section 82 comprises receiving teeth 84 extending from the wall portions 76, 78 into the receiving channel 80. The receiving teeth 84 on the first outer wall portion 76 are mirror image identical to the corresponding receiving teeth on the opposite second outer wall portion 78, as shown in FIG. 2. Therefore there are matched pairs of opposite receiving teeth that engage corresponding opposite sides of the engaging wall, as is shown in FIGS. 2 and 4.

A blank portion 86 extends from the tooth section 82 to the mounting plate 72.

The receiving wall comprises a first guide recess area 89 comprising upper and lower guide recesses 90 in each of the outer wall portions 76, 78. In some embodiments, the recesses 90 are located adjacent the second end 75 of the attachment member 54. The guide recesses provide vertical access from the receiving channel 80. The upper and lower guide recesses 90 are configured to receive the guide bars 66. When the guide bars are received in the guide recesses, the attachment member 54 is secured against horizontal movement in the directions H and I relative to the base. The recesses 90 extend are perpendicular to the mounting plate 72, and more specifically perpendicular to a rear face 94 and a front face 95 of the mounting plate 72. In some embodiments, the first guide recess area comprises one guide recess corresponding to one guide protrusion of the first guide bar area.

Adjacent the first end 73 of the attachment member 54 is a first attachment member gusset area 99. The first attachment member guest area comprises a first attachment member gusset set, an upper gusset channel 108, a lower gusset channel 110, a first upper relief slot 116, a second upper relief slot 118, a first lower relief slot 120, and a second lower relief slot 122. The first attachment member gusset set comprises a first upper gusset plate 100, a second upper gusset plate 102, a first lower gusset plate 104, and a second lower gusset plate 106. In some embodiments, the first upper gusset plate 100 is co-planar with the first lower gusset plate 104 and the second upper gusset plate 102 is co-planar with the second lower gusset plate 106.

The upper gusset channel 108 is formed by the first upper gusset plate 100 and the second upper gusset plate 102. The upper gusset channel 108 is also partially formed by break walls 78*c* of the upper wall portion 78 on opposite sides of the channel 108. The lower gusset channel 110 is formed by the first lower gusset plate 104 and the second lower gusset plate 106. The lower gusset channel 110 is also partially formed by break walls 76*c* of the lower wall portion 76 on opposite sides of the channel 110. The break walls are defined by the thickness of the respective wall portions 78, 76. In some embodiments, the gusset plates are co-planar with the break walls as shown in FIG. 3. In some embodiments, the gusset plates are offset and not co-planer with the break walls so that a distance of the gusset channel between the break walls is narrower than the distance between the gusset plates. In some embodiments, the upper gusset channel 108 is co-planar with the lower gusset channel 110.

The first upper gusset plate 100 and the second upper gusset plate 102 each are attached to and form a triangle between the rear face 94 of the mounting plate 72 and the outer surface 78*a* of upper wall portion 78. The first lower gusset plate 104 and the second lower gusset plate 106 each are attached to and form a triangle between the rear face 94 of the mounting plate 72 and the outer surface 76*a* of lower wall portion 76. The gusset plates 100, 102, 104, 106 are perpendicular to the receiving wall 74 and to the mounting plate 72.

While the gusset plates 100, 102, 104, 106 are shown in a triangle shape, other shapes may be used, such as square, rectangle, arching, or irregular. The gusset plates 100, 102, 104, 106 strengthen and support the receiving wall 74 when provided with loads in vertical directions C and D to prevent overstressing or permanent deformation of the wall portions 76 and 78.

Adjacent the first upper gusset plate 100 opposite upper gusset channel 108 is the first upper relief slot 116 in the upper wall portion 78. Adjacent the second upper gusset plate 102 opposite upper gusset channel 108 is the second upper relief slot 118 in the upper wall portion 78. The first and second upper relief slots extend from a distal end 81 of the receiving wall toward the rear face 94 of the mounting plate 72.

Adjacent the first lower gusset plate 104 opposite the lower gusset channel 110 is the first lower relief slot 120 in the lower wall portion 76. Adjacent the second upper gusset plate 106 opposite lower gusset channel 110 is the second lower relief slot 122 in the lower wall portion 76. The first and second lower relief slots extend from a distal end 81 of the receiving wall toward the rear face 94 of the mounting plate 72.

Upper rigid portions 112, 114 are provided between the relief slots 116, 118, and the respective gusset plates 100, 102. Lower rigid portions 124, 126 are provided between the relief slots 120, 122, and the respective gusset plates 104, 106. The rigid portions 112, 114, 124, 126 have limited or no flexibility in the vertical directions C and D given the close proximity of the connection with the respective gusset plate 100, 102, 104, 106. Therefore, the gusset plates 100, 102, 104, 106 impart rigidity to the rigid portions 112, 114, 124, 126.

The inner surface 78*b* of the upper wall portion 78 at the rigid portions 112, 114 is flat and does not have teeth. The inner surface 76*b* of the lower wall portion 76 at the rigid portions 124, 126 is flat and does not have teeth.

The relief slots 116, 118, 120, 122 allow the vertical flexibility in the wall portions 76, 78 outside of the rigid portions 112, 112, 114, 124, 126. In particular, the relief slots 116, 118, 120, 122 allow the vertical flexibility in areas of the wall portions 76, 78 in and adjacent the toothed sections 82 outside of the rigid portions 112, 112, 114, 124, 126. Such flexibility is desirable to allow the wall portion 76, 78 to flex outward and way from the receiving channel 80 to enlarge the receiving channel so that the engaging wall can enter, and optionally be withdrawn from, the receiving channel 80. In this way, the base teeth 60 of the engaging wall can move past the receiving teeth 84 of the toothed section 82 during installation and removal of the engaging wall 58 as further explained below.

In some embodiments, the length of the relief recesses depends on the length of the toothed section 82. In some embodiments, the length of the receiving channel is one-third, one-fourth, or one-eighth, or any distanced in between those lengths, of the length of the receiving wall between the distal end and the rear face 94. In some embodiments, the relief recess is ½ inch from the adjacent gusset plate.

The base comprises a first base gusset area 127. The first base gusset area comprises a first base gusset set and flat portions 132, 134, 136 (inner flat portion adjacent to the gusset plate 130 not shown).

The first base gusset set comprises an upper base gusset plate 128 and a lower base gusset plate 130. Flat portions 132, 134, 136 (inner flat portion adjacent gusset plate 130 not shown), are provided on the engaging wall 58 on opposite sides of the respective gusset plates 128, 130. The flat portions have a horizontal length that is less than or equal to the horizontal length between horizontally adjacent relief slots 116, 118 and 120, 122, respectively. The flat portions interrupt the base teeth 60.

The gusset plate 128 is connected to and forms a triangle between the flat portions 132, 134 of the engaging wall 58 and the front face 59 of the back plate 56. The gusset plate 130 is connected to and forms a triangle between the flat portions 136 (inner flat portion adjacent gusset plate 130 not shown) of the engaging wall 58 and the front face 59 of the back plate 56. The gusset plates 128, 130 are perpendicular to the engaging wall 58 and the back plate 56.

While the gusset plates 128, 130 are shown in a triangle shape, other shapes may be used, such as square, rectangle, arching, or irregular. The gusset plates 128, 130 strengthen and support the engaging wall 58 when provided with loads in vertical directions C and D to prevent overstressing or permanent deformation of the engaging wall 58.

The upper gusset plate 128 is receivable in the upper gusset channel 108. The lower gusset plate 130 is receivable in the lower gusset channel 110 as shown in FIG. 3. In some embodiments, the upper base gusset plate 128 is in surface to surface contact with one or both of the first and second upper gusset plates 100, 102. In some embodiments, the lower base gusset plate 130 is in surface to surface contact with one or both of the first and second lower gusset plates 104, 106. In some embodiments, the upper base gusset plate 128 is in surface to surface contact with one or both of the break walls 78*c* on opposite sides of the channel 108. In some embodiments, the lower base gusset plate 130 is in surface to surface contact with one or both of the break walls 76*c* on opposite sides of the channel 110. In some embodiments, the upper gusset plate 128 is parallel to the first and second upper gusset plates 100, 102 and the lower base gusset plate 130 is parallel to the first and second lower gusset plates 104, 106 when the upper gusset plate 128 is received in the upper gusset channel 108 and the lower gusset plate 130 is received in the lower gusset channel 110.

The receipt of the gusset plates 128, 130 in the gusset channels 108, 110 combines the vertically stabilizing action of the gusset plates 100, 102, 104, 106, 128, 132. This increase the vertical loads that can be carried by the attachment system 50 and prevents the engagement wall and the receiving wall from deforming in the vertical direction. Also, receipt of the gusset plates 128, 130 in the gusset channels 108, 110 secures the attachment member 54 against horizontal movement in the horizontal directions H and I relative to the base 52.

The inner surface 78*b* of the upper wall portion 78 at the rigid portions 112, 114 slides on or adjacent flat portions 123, 134 on opposite sides of gusset plate 128 as the receiving wall is moved over the engaging wall in the direction A or is withdrawn in the direction B. The inner surface 76*b* of the lower wall portion 76 at the rigid portions 124, 126 slides one or adjacent flat portion 136, (inner flat portion adjacent gusset plate 130 not shown) on opposite sides of gusset plate 130 as the receiving wall is moved over the engaging wall in the direction A or is withdrawn in the direction B.

In one application, the base 52 is attached to the backup wall 38 with screws 71, insulation panels 32 are placed over a portion of the base 52 adjacent one or both sides of the engaging wall 58. The width of the back plate 56 of the base 52 spaces the insulation panels 32 from the backup wall 38. The resulting gap 57 facilitates drainage.

Then the receiving wall 74 of the attachment member 54 is moved so that the end opening 88 is aligned with the engaging wall 58 of the base 52, and more particularly the front end 64 of the engaging wall 58. The front end 64 is arrow shaped. The opposite sides of the end opening 88 have angled surfaces to receive the arrow shaped front end 64. The attachment member 54 is moved in the direction A of FIGS. 2 and 4. The receiving teeth 84 engage and slide over the base teeth 60 and drive the outer wall portions 76, 78 outward and away from each other in the directions C and D, respectively. The outer wall portions 76, 78 are driven outward because the widest portion of the engaging wall 58 having base teeth 60 is wider than the narrowest portion of the receiving channel 80 in the toothed section 82 in a non-flexed state.

As the attachment member 54 moves in the direction A, the outer wall portions 76, 78 reciprocate or ratchet between expanding in the directions C and D, respectively, as the widest portion of the base teeth 60 encounter the widest portion of the receiving teeth 84, and then falling back in the directions E and F, respectively, as the narrowest portion of the base teeth 60 encounter the narrowest portion of the receiving teeth 84, as the receiving teeth ride up and down along the base teeth. The outer wall portions are semi-flexible within a range of motion and biased in the directions E and F to a certain point at least sufficient to achieve the interlocked engagement of the receiving channel teeth with the base teeth as shown in FIGS. 2 and 4.

The attachment member 54 can be moved forward in the direction A until a rear face 94 of the mounting plate 72 contacts or is in close proximity to a front face 42 of an insulation panel 32. In this way, the mounting plate secures and holds the insulation panel(s) 32 adjacent the backup wall 38 and against the front face 59 of the back plate 69. Therefore adhesive applied or adhesive backing on the insulation panel(s) is not needed. The attachment member has a range of adjustment from where only the first base tooth 60*a* of the engagement wall in is the receiving channel adjacent the first recess tooth 84*a* to where the arrow shaped end front end 64 is received in the corresponding arrow shaped end portion 98 of the receiving channel 80. Therefore, the attachment member is movable relative to the base to account for and secure insulation panels of various depths.

After the attachment member is mounted on the engaging member, cladding 30 can be secured to the mounting plate 72 as shown in FIGS. 5-7. In some applications, the cladding panel 30 has first and second vertical groove recesses 31, 41 on opposite sides of panel 30. The first vertical grove recess comprises a first groove side wall 37, a groove base 29 and a second groove side wall 39*a*. A beveled edge 35 extends between a first outer edge 33 and the first groove side wall 37. The side wall 35 extends to the groove base. The second groove side wall 39*a* extends to the groove base opposite the first groove side wall 37. The first groove side wall 37 is horizontally longer than the second groove side wall 39*a*.

The second vertical groove 41 comprises a first groove side wall 41*a*, a groove base 45, and a second groove side wall 43. The side wall 41*a* extends to the groove base 45. The second groove side 43 wall extends to the groove base 45 opposite the first groove side wall 41*a*. The first groove side wall 41*a* is horizontally shorter than the second groove side wall 43.

A cladding connection member 20 can be used to hold the cladding panel 30 to the mounting plate 72 of the attachment member 54. The member 20 has a mounting plate engaging portion 22, a step portion 24 and a cladding engagement portion 26. The cladding engagement portion 26 is offset from the mounting plate engaging portion 22 by the thickness of the cladding at the first groove side wall 37. The mounting plate engaging portion 22 is fastened to the front face 95 of the mounting plate 72 with a fastener, such as a bolt 47. The cladding engagement portion 26 engages the face of the first groove side wall 37 to secure the cladding against the front face 95 of the mounting plate 72. The thickness of the cladding engagement portion 26 is sufficiently thin to allow a next cladding panel to be placed into the first vertical groove recess 31 to continue the cladding across the wall in a tongue in grove fashion.

A side wall 44 of the insulation panel may abut the gusset plates 102, 128. The side walls of various insulation panels may abut the outside walls of each gusset plate 100, 102, 104, 106, 128, 130. Alternatively cuts can be made in the insulation panels to accommodate the gusset plates 100, 102, 104, 106, 128, 130. The bottom wall of the panel insulations may rest on the outer surface 78*a* of the upper wall portion 78 and an upper portion of the exposed engaging wall. The top wall of the insulation panels may be in contact with or adjacent to the outer surface 76*a* of the lower wall portion 67 and a lower portion of the exposed engaging wall.

While only one cladding attachment system 50 is shown in FIGS. 6 and 7, multiple cladding attachment systems can be deployed in an application. Depending on the needs of a given application, the cladding attachment systems 50 can be positioned end-to-end at a given vertical height, attachment systems 50 can be spaced apart at a given vertical height, and or attachment systems 50 can be positioned at various predefined vertical heights and or horizontal positions.

The attachment system 50 transfers compressive force or load that is provided to the exterior of the cladding 30, such as by winds, through the attachment system 50, onto the backup wall 38. In some applications, the force or load is transferred from the attachment member to the outer face of the insulation panel, through the insulation panels, through the base 52, and onto the backup wall 38.

In some applications, the mounting plate is substantially parallel to the back plate when the attachment member is joined to the base.

To remove the attachment member 54 from the base 52, the outer wall portions 76, 78 must be expanded in the directions C and D, respectively, until the receiving teeth 84 release from base teeth 60 sufficiently to allow clearance between the two sets of teeth and the attachment member to be withdrawn in the direction B of FIGS. 2 and 4.

The front face 95 of the mounting plate 72 has a plurality of horizontally extending fastener grooves 96. In some embodiments, these fastener grooves extend the entire length of the front face 95. The fastener grooves 96 receive the end point 48 of a fastener such as a nail 46, a screw, or a blot 47. The groove prevents the nail, screw, bolt, or other fastener from moving out of place when first being driven or is first penetrating the front face 95.

Figure 8:
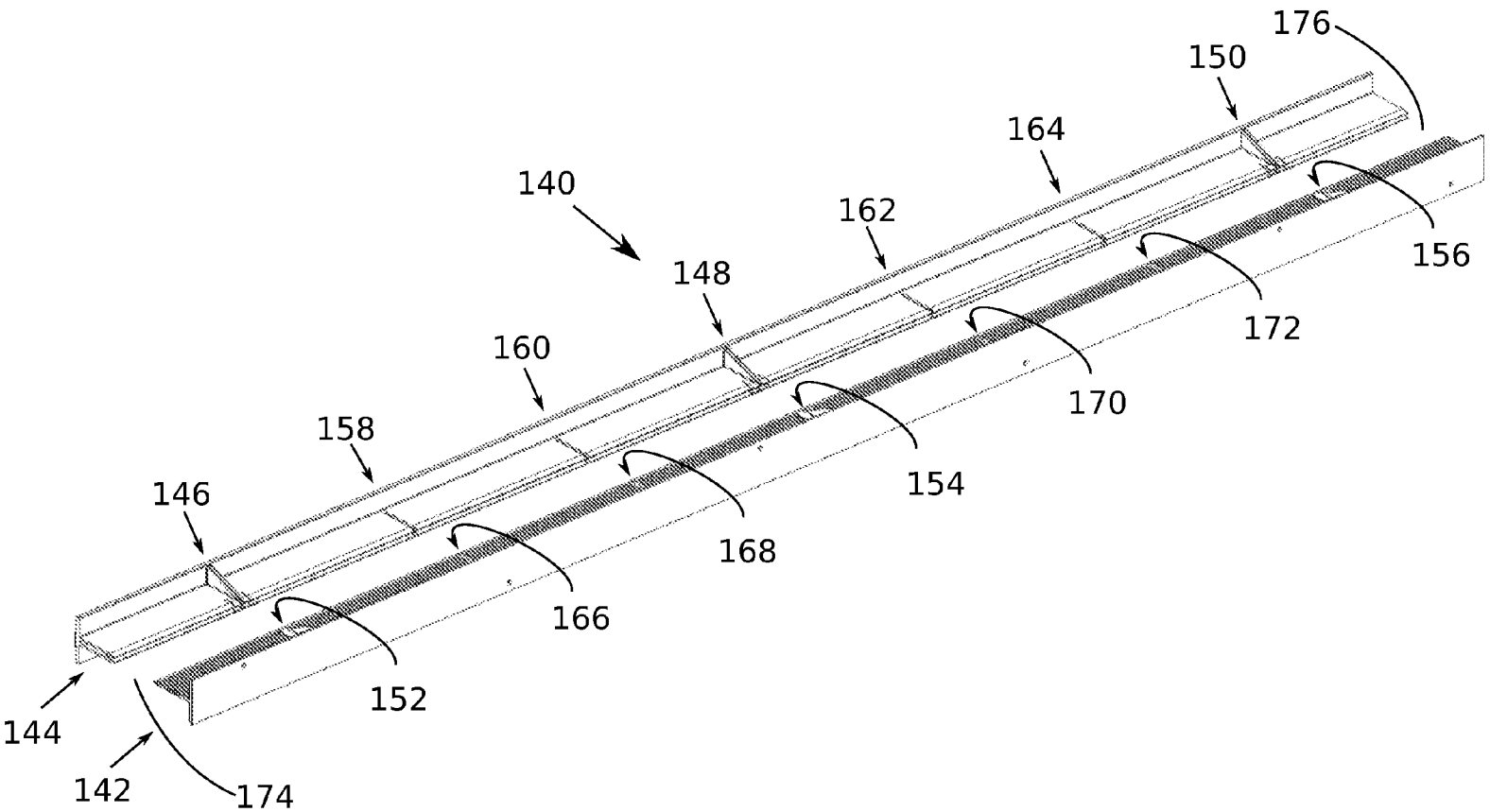
FIG. 8 is a perspective exploded view of a second embodiment cladding attachment system.

FIG. 8 shows a second embodiment of the cladding attachment system 140. The system 140 comprises a base 142 and an attachment member 144. The system 140 is identical to the system 50 except the system 140 comprises multiple spaced apart attachment member gusset areas 146, 148, 150, base gusset areas 152, 154, 156, guide recess area 158, 160, 162, 164, and guide bar areas 166, 168, 170, 172.

Attachment member gusset areas 146, 148, 150 are each identical to the first attachment member gusset set area 99. Base gusset areas 152, 154, 156 are each identical to the first base gusset set area 127. Guide recess area 158, 160, 162, 164 are each identical to the first guide recess area 89. Guide bar areas 166, 168, 170, 172 are each identical to first guide bar area 65.

While three attachment gusset area and base gusset area sets (146, 152), (148, 154), (150, 156) are shown in FIG. 8, in some embodiments, any number of attachment gusset area and base gusset area sets and guide bar areas may be provided in a given application. Therefore, the system can extend continuously from the first end 174 and/or the second end 176 so that the system 140 runs continuously along a wall or other application with the attachment gusset area and base gusset area sets repeating at regular intervals. In some embodiments, the system can be manufactured with the distance between adjacent attachment gusset area and base gusset area sets provided according to the needs of a particular application. For example, if additional support is needed for a given application, the system can be manufactured with distance between adjacent attachment gusset area and base gusset area sets being closer than is shown in FIG. 8.

The system 140 shows that two guide recess areas and guide bar areas are located between two adjacent attachment gusset area and base gusset area sets. For example guide recess areas 158, 160 and guide bar areas 166, 168 are located between attachment gusset areas 146, 148 and base gusset areas 152, 154. In some embodiments, only one guide recess area and guide bar area is between adjacent attachment gusset areas and guide bar areas. In some embodiments, more than two guide recess areas and guide bar areas are located between adjacent attachment gusset areas and guide bar areas. In some embodiments, no guide recess area and guide bar areas is located between adjacent gusset area and guide bar area sets in at least some portion of the system.

Figure 9:
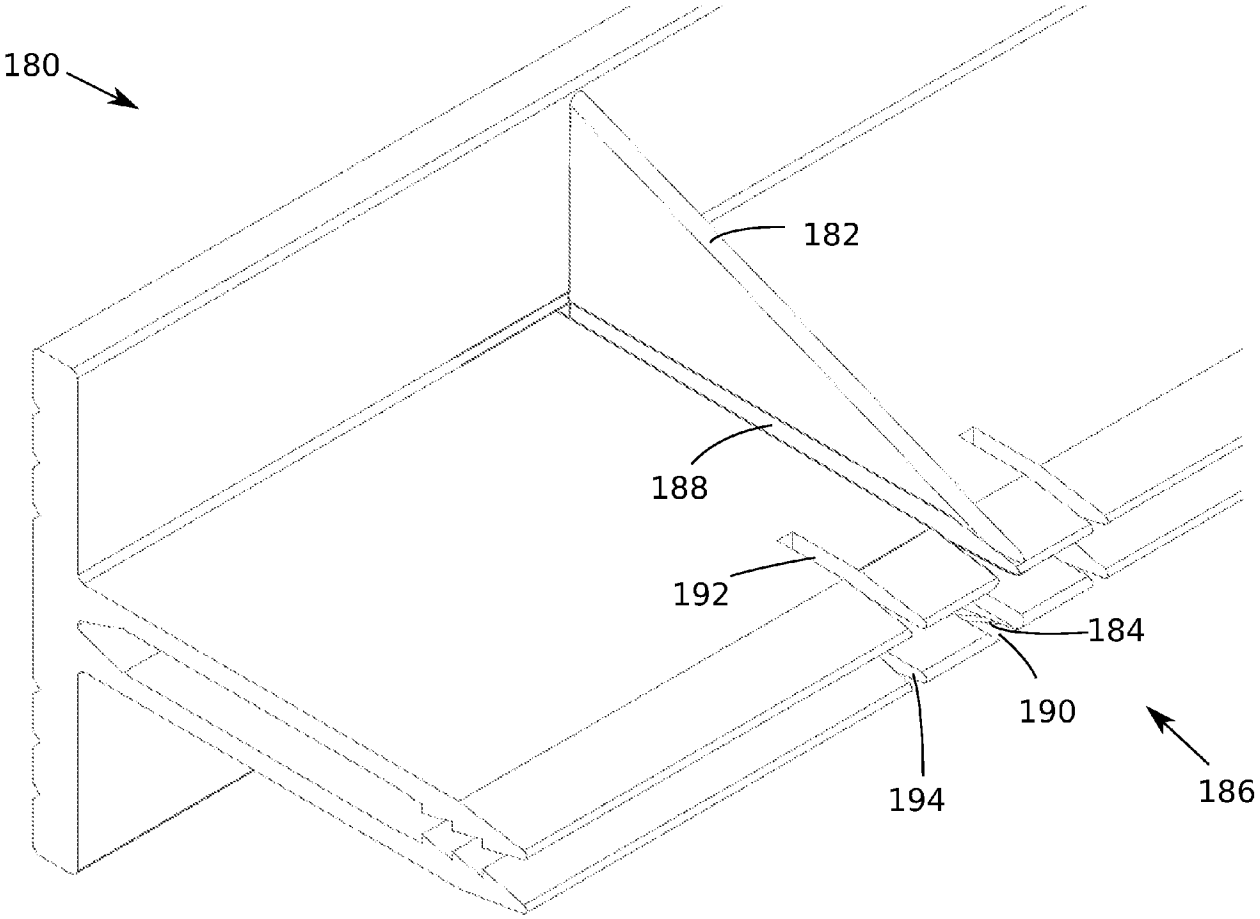
FIG. 9 is a perspective view of a portion of an attachment member from a third embodiment cladding attachment system.

FIG. 9 shows a portion of an attachment member 180 from a third embodiment cladding attachment system. The attachment system of FIG. 9 is identical to the attachment systems 50 or 140, except that attachment member 180 does not have the first upper gusset plate 100 and the first lower gusset plate 104 that attachment member 54 has. Therefore attachment member 180 has only one attachment member upper gusset plate 182 and one attachment member lower gusset plate 184 per attachment member gusset set 186.

An upper gusset channel 188 is bounded on one side by the gusset plate 182, and is partially open on the opposite side, except for the break wall, because of the lack a second upper gusset plate, such as upper gusset plate 100 of attachment member 54. A lower gusset channel 190 is bounded on one side by the gusset plate 184, and is open partially on the opposite side, except for the break wall, because of the lack a second lower gusset plate, such as lower gusset plate 104 of attachment member 54. In some embodiments, the relief recesses 192, 194 are also removed.

While the attachment member 180 is shown having a gusset plate 182, 184 on one side of the gusset channels 188, 190, respectively, in some embodiments, the gusset plate is provide on the side of gusset channels 188, 190, respectively, opposite of that shown in FIG. 9. Therefore, as an example with reference to attachment member 54, gusset plates 102, 106 would be removed, while gusset plates 100, 104 would remain.

Figure 10:
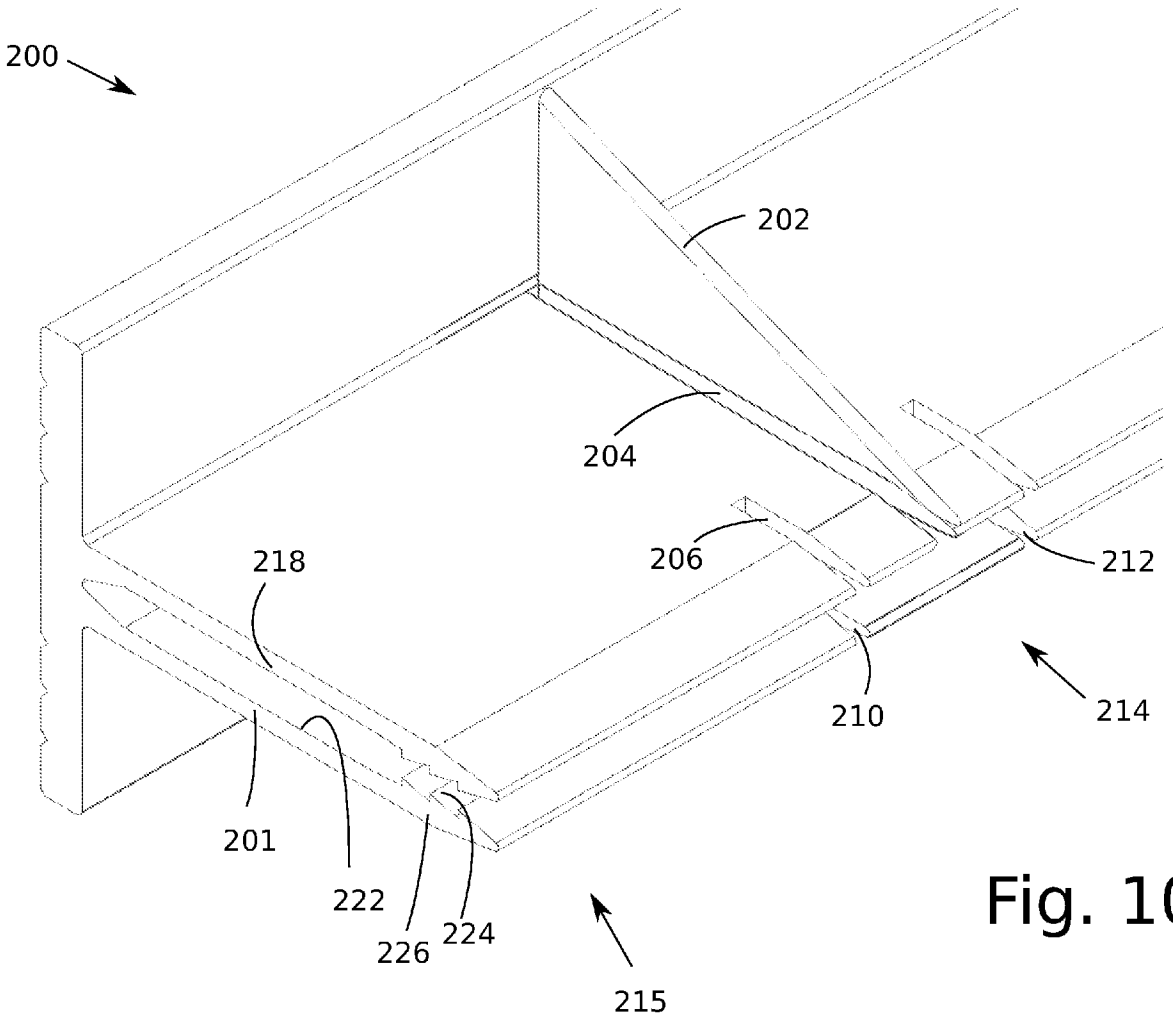
FIG. 10 is a perspective view of a portion of an attachment member from a fourth embodiment cladding attachment system.

FIG. 10 shows a portion of an attachment member 200 from a fourth embodiment cladding attachment system. The attachment system of FIG. 10 is identical to attachment systems 50 or 140, except that the base member (not shown) does not have a lower gusset plate 130 as base 52 has, and attachment member 200 does not have the first upper gusset plate 100, the first lower gusset plate 104, and the second lower gusset plate 106 that attachment member 54 has. Therefore attachment member 200 has only one attachment member gusset plate 202 per attachment member gusset area 214 and base (not shown) only has one engaging member upper gusset plate (not shown).

An upper gusset channel 204 is bounded on one side by the gusset plate 202 and is open on the opposite side because of the lack of a second upper gusset plate, such as upper gusset plate 100 of attachment member 54. There is no lower gusset channel because the base (not shown) lacks a lower gusset plate. In some embodiments, the lower relief slots 210, 212 are removed. In some embodiments, upper relief slot 206 is removed.

While the attachment member 200 is shown having a gusset plate 202 on one side of the gusset channel 204, in some embodiments, the gusset plate is provide on the side of gusset channels 204, opposite of that shown in FIG. 10. In some embodiments, an inner surface 222 of the lower wall portion 216 of the engaging wall 215 is not flat or blank, but has teeth 224 between the lower relief slots, if the relief slots exist, or if they do not exist then the teeth 224 extend continuously a toothed section 226.

In some embodiments, all of the upper gussets are removed and only one lower gusset is provided on the attachment member extending from a lower surface of the lower portion 201 of the engaging wall 215. In some embodiments, the gusset plates alternate at each adjacent gusset area between only an upper gusset plate and only a lower gusset plate along each of the attachment member and base.

In some embodiments, the each gusset area of the attachment member and the base member can be any combination of the type of gusset areas and gusset sets shown or described herein. For example embodiment, one gusset set comprises the gusset arrangement shown in FIG. 1, the next adjacent gusset set in the same embodiment comprises the gusset arrangement shown or described regarding FIG. 9, and the next adjacent gusset set in the same embodiment may comprise the gusset arrangement shown or described regarding FIG. 10.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A cladding attachment system for connecting cladding to a vertical support wall, comprising:

a base comprising an engaging wall, a back plate, and a base gusset plate, the engaging wall extending transversely from the back plate, the engaging wall comprising a plurality of base teeth, the back plate configured to attach to the support wall, and the base gusset plate is connected to the back plate and the engaging wall;

an attachment member comprising a mounting plate, a receiving wall, an attachment member gusset plate, and a gusset channel;

the receiving wall extending transversely from the mounting plate, the receiving wall comprising a receiving channel configured to receive the engaging wall, the receiving channel is transverse to the mounting plate, the receiving wall comprises two interior walls adjacent the receiving channel, each interior wall comprises a one or more receiving teeth extending into the receiving channel to engage one or more of the plurality of base teeth to releasably join the attachment member to the base, the mounting plate comprises a cladding connecting surface, the mounting plate is spaced apart from the back plate;

the attachment member gusset plate is connected to the receiving wall and the mounting plate, the gusset channel receives the base gusset plate when the engaging wall is received in the receiving channel;

the attachment member gusset plate and the base gusset plate are located between the back plate and the mounting plate when the engaging wall is received in the receiving channel; and the attachment member gusset plate overlaps the base gusset plate when the engaging wall is received in the receiving channel.

2. The system of claim 1, wherein the attachment member gusset plate is adjacent the gusset channel.

3. The system of claim 1, wherein a side surface of the attachment member gusset plate forms a wall of the gusset channel.

4. The system of claim 1, wherein the attachment member gusset plate is perpendicular to the receiving wall and the mounting plate, the attachment member gusset plate comprises a member first end and a member second end, the member first end is joined to the receiving wall and the member second end is joined to the mounting plate; the base gusset plate is perpendicular to the back plate and the engaging wall, the base gusset plate comprises a base first end and a base second end, the base first end is joined to the back plate and the base second end is joined to the engaging wall.

5. The system of claim 4, wherein the back plate is perpendicular to the engaging wall, the receiving wall is perpendicular to the mounting plate, the attachment member gusset plate comprises a triangular shape; and the base gusset plate comprises a triangular shape.

6. The system of claim 1, wherein the attachment member gusset plate is in surface to surface contact with the base gusset plate when the base gusset plate is received in the gusset channel.

7. The system of claim 1, wherein the attachment member gusset plate is parallel to and adjacent to the base gusset plate when the base gusset plate is received in the gusset channel.

8. The system of claim 1, wherein the gusset channel intersects the receiving channel.

9. The system of claim 1, wherein the attachment member gusset plate is a first attachment member gusset plate, and the attachment member comprises a second attachment member gusset plate, the first attachment member gusset plate and the second attachment member gusset plate are located on opposite sides of the gusset channel.

10. The system of claim 9, wherein an inside surface of the first attachment member gusset plate forms a first wall of the gusset channel, an inside surface of the second attachment member gusset plate forms a second wall of the gusset channel, the first wall of the gusset channel is opposite the second wall of the gusset channel.

11. The system of claim 1, wherein, the attachment member gusset plate is a first upper attachment member gusset plate, and the attachment member comprises a second upper attachment member gusset plate, a first lower attachment member gusset plate, and a second lower attachment member gusset plate, the first upper attachment gusset plate and the second upper attachment member gusset plate are connected to the mounting plate and the receiving wall on an upper side of the receiving wall, the first lower attachment member gusset plate and the second lower attachment member gusset plate are connected to the mounting plate and the receiving wall on a lower side of the receiving wall;

the gusset channel is an upper gusset channel, and the attachment member comprises a lower gusset channel, the upper gusset channel intersects with a upper wall of the two interior walls and the lower gusset channel intersects with a lower wall of the two interior walls;

the base gusset plate is an upper base gusset plate, and the base comprises a lower base gusset plate, the lower base gusset plate is connected to the back plate and the engaging wall on a lower side of the engaging wall, the upper base gusset plate is connected to the back plate and the engaging wall on an upper side of the engaging wall;

the first upper attachment member gusset plate and the second upper attachment member gusset plate are located on opposite sides of the upper gusset channel, the upper gusset channel receives the upper base gusset plate when the engaging wall is received in the receiving channel;

the first lower attachment member gusset plate and the second lower attachment member gusset plate are located on opposite sides of the lower gusset channel, the lower gusset channel receives the lower base gusset plate when the engaging wall is received in the receiving channel.

12. The system of claim 11, wherein the first upper attachment member gusset plate is co-planar with the first lower attachment member gusset plate; the second upper attachment member gusset plate is co-planar with the second lower attachment member gusset plate; and the upper gusset channel is coplanar with the lower gusset channel.

13. The system of claim 11, wherein an inside surface of the first upper attachment member gusset plate forms a first wall of the upper gusset channel, an inside surface of the second upper attachment member gusset plate forms a second wall of the upper gusset channel, the first wall of the upper gusset channel is opposite the second wall of the upper gusset channel an inside surface of the first lower attachment member gusset plate forms a first wall of the lower gusset channel, an inside surface of the second lower attachment member gusset plate forms a second wall of the lower gusset channel, the first wall of the lower gusset channel is opposite the second wall of the lower gusset channel;

the engaging wall is perpendicular to the back plate, and the receiving wall is perpendicular to the mounting plate;

the mounting plate is substantially parallel to the back plate when the attachment member is joined to the base;

the receiving channel extends along an entire horizontally length of the receiving wall;

the engaging wall comprises horizontally extending alignment bars on opposite exterior surfaces of the engaging wall, and the receiving wall comprises horizontally extending alignment recesses, and when the alignment bars are received in the alignment recesses, the attachment member is prevented from moving in a horizontal direction.

14. The system of claim 1, wherein the engaging wall is perpendicular to the back plate, and the receiving wall is perpendicular to the mounting plate; and the mounting plate is substantially parallel to the back plate when the attachment member is joined to the base.

15. The system of claim 1, wherein the engaging wall comprises an alignment protrusion, the receiving wall comprises an alignment recess, the attachment member is prevented from moving in a horizontal direction when the alignment protrusion is received in the alignment recess.

16. The system of claim 15, comprising a first gusset group, a second gusset group, and an alignment group;

the base gusset plate is a first base gusset plate, the attachment member gusset plate is a first attachment member gusset plate, and the gusset channel is a first gusset channel;

the first gusset group comprises the first base gusset plate, the first attachment member gusset plate, and the first gusset channel;

the base comprises a second base gusset plate, the attachment member comprises a second attachment member gusset plate and a second attachment member gusset channel, the second base gusset plate is connected to the back plate and the engaging wall, the second attachment member gusset plate is connected to the receiving wall and the mounting plate, the second attachment member gusset channel receives the second base gusset plate when the engaging wall is received in the receiving channel, the second gusset group comprises the second base gusset plate, the second attachment member gusset plate, and the second attachment member gusset channel;

the alignment group comprises the alignment protrusion and the alignment recess; and, the alignment group is located between the first gusset group and the second gusset group.

17. The system of claim 1, wherein the engaging wall comprises horizontally extending alignment bars on opposite exterior surfaces of the engaging wall; and the receiving wall comprises horizontally extending alignment recesses, and when the alignment bars are received in the alignment recesses, the attachment member is prevented from moving in a horizontal direction.

18. The system of claim 1, wherein the engaging wall has at least two opposite sides; the plurality of base teeth extend along substantially an entire surface of each of the two opposite sides.

19. A cladding attachment device for connecting cladding to a vertical support wall, comprising:

a base comprising a horizontal engaging wall, a back plate, and a base gusset plate, the horizontal engaging wall extending transversely from the back plate and horizontally along the back plate, the engaging wall comprising a plurality of base teeth, the back plate configured to attach to the vertical support wall, and the base gusset plate is transversely connected to the back plate and the engaging wall;

an attachment member comprising a cladding mount plate, a horizontal receiving wall, an attachment member gusset plate, and a gusset channel;

the horizontal receiving wall extending from the cladding mount plate and horizontally along the cladding mount plate, the receiving wall comprising a horizontally elongated receiving slot, the elongated receiving slot is transverse to the mount plate, the receiving slot comprises a plurality of opposing receiving teeth, the elongated receiving slot configured to receive the engaging wall and the opposing receiving teeth configured to engage the base teeth to prevent the attachment member from moving in at least one horizontal direction;

the attachment member gusset plate is transversely connected to the receiving wall and the mount plate, the gusset channel receives the base gusset plate when the engaging wall is received in the receiving slot;

the attachment member gusset plate and the base gusset plate are located between the back plate and the mounting plate when the engaging wall is received in the receiving slot; and, the attachment member gusset plate overlaps the base gusset plate when the engaging wall is received in the receiving slot.

20. The device of claim 19, wherein the engaging wall is perpendicular to the back plate, and the receiving wall is perpendicular to the mount plate; and the mount plate is substantially parallel to the back plate when the attachment member is joined to the base.

21. The device of claim 19, wherein the engaging wall comprises horizontally extending alignment bars on opposite exterior surfaces of the engaging wall; and the receiving wall comprises horizontally extending alignment recesses, and when the alignment bars are received in the alignment recesses, the attachment member is prevented from moving in the at least one horizontal direction.

22. A method of attaching cladding to a support wall, comprising the steps of:

attaching a back plate of a base to the support wall, the base having a horizontal engaging wall extending perpendicularly from the back plate, the engaging wall comprising a plurality of base teeth on opposite sides of the engaging wall;

aligning vertically a horizontally elongated receiving channel of a receiving wall of an attachment member with the engaging wall;

aligning an attachment member gusset channel of the attachment member with a base gusset plate of the base, the base gusset plate is connected to the back plate and the engaging wall, the attachment member gusset channel intersecting the receiving channel;

moving the elongated receiving channel over the receiving wall and the attachment member gusset channel over the base gusset plate and overlapping the base gusset plate with the attachment member gusset plate;

engaging a plurality of receiving teeth on opposite sides of the elongated receiving channel with the plurality of base teeth of the receiving wall to prevent the attachment member from moving in an at least one first horizontal direction opposite the base;

holding an insulation panel adjacent the support wall with a mount plate of the attachment member, the mount plate is perpendicular to the receiving channel, an attachment member gusset plate connected to the mount plate and the engaging wall;

attaching cladding to the mount plate of the attachment member; and supporting a vertical load of the cladding, at least in part, with the attachment member gusset plate and the base guest plate between the mount plate and the back plate.

23. The method of claim 22, comprising the step of after aligning vertically, aligning horizontally the elongated receiving channel of the receiving wall with the engaging wall by aligning guide recesses of the receiving wall with guide bars of the engaging wall.

24. The method of claim 22, wherein the step of moving comprises moving the elongated receiving channel in a second direction opposite of the at least one first horizontal direction; and wherein the step of engaging comprises sliding the receiving teeth over the base teeth until the mount plate is in a desired position.

25. The device of claim 19, wherein the attachment member gusset plate is in surface to surface contact with the base gusset plate when the base gusset plate is received in the gusset channel.

26. The system of claim 1, wherein the base gusset plate is attached to a side of the back plate that faces the mounting plate when the engaging wall is received in the receiving channel, the attachment member gusset plate is attached to a side of the mount plate that faces the back plate when the engaging wall is received in the receiving channel.

* * * * *